US009289906B2

(12) United States Patent
Croft

(10) Patent No.: US 9,289,906 B2
(45) Date of Patent: Mar. 22, 2016

(54) DEVICE FOR CUTTING HAIRS

(71) Applicant: Rachel Croft, Palo Alto, CA (US)

(72) Inventor: Rachel Croft, Palo Alto, CA (US)

(73) Assignee: EQUIP BEAUTY, INC., Palo Alto, CA (US)

( * ) Notice: Subject to any disclaimer, the term of this patent is extended or adjusted under 35 U.S.C. 154(b) by 336 days.

(21) Appl. No.: 13/802,043

(22) Filed: Mar. 13, 2013

(65) Prior Publication Data

US 2013/0255086 A1 Oct. 3, 2013

Related U.S. Application Data

(60) Provisional application No. 61/618,155, filed on Mar. 30, 2012, provisional application No. 61/745,362, filed on Dec. 21, 2012.

(51) Int. Cl.

| | |
|---|---|
| ***B26B 13/24*** | (2006.01) |
| ***B26B 15/00*** | (2006.01) |
| ***A45D 24/36*** | (2006.01) |
| ***B26B 21/12*** | (2006.01) |
| ***B26B 21/40*** | (2006.01) |
| ***A45D 44/00*** | (2006.01) |

(52) U.S. Cl.

CPC ..... *B26B 15/00* (2013.01); *A45D 24/36* (2013.01); *A45D 44/00* (2013.01); *B26B 13/24* (2013.01); *B26B 21/12* (2013.01); *B26B 21/4081* (2013.01)

(58) Field of Classification Search

CPC ..... A45D 24/36; A45D 44/00; B26B 15/00; B26B 21/12; B26B 13/24; B26B 21/4081

USPC ..... 30/30, 123, 124, 131, 134, 162, 195, 30/208–210, 233.5, 278, 279.2, 296.1, 320

See application file for complete search history.

(56) References Cited

U.S. PATENT DOCUMENTS

| | | | |
|---|---|---|---|
| 4,020,549 | A | 5/1977 | Edwards |
| 4,159,566 | A | 7/1979 | Patrin |
| 4,517,998 | A | 5/1985 | Furco |
| 4,744,145 | A | 5/1988 | Lee |
| 4,850,110 | A | 7/1989 | Meiser, Jr. |

(Continued)

FOREIGN PATENT DOCUMENTS

| | | | |
|---|---|---|---|
| CN | 2642109 | Y | 9/2004 |
| CN | 2787049 | Y | 6/2006 |

(Continued)

OTHER PUBLICATIONS

Notification of Transmittal of the International Search Report and the Written Opinion, dated Jun. 26, 2013, in International Appl. No. PCT/US2013/033891 filed Mar. 26, 2013.

(Continued)

*Primary Examiner* — Ned Landrum
*Assistant Examiner* — Liang Dong
(74) *Attorney, Agent, or Firm* — Vierra Magen Marcus LLP

(57) ABSTRACT

In specific embodiments, a device for cutting hairs comprises a pair of opposing surfaces actuatable so that the hairs are capable of being held between the opposing surfaces with sufficient firmness to allow the hairs to be pulled taut without being cut. The device also includes a cutter actuatable independent of the opposing surfaces and configured to cut the hairs held between the opposing surfaces when the cutter is actuated.

22 Claims, 10 Drawing Sheets

(56) References Cited

U.S. PATENT DOCUMENTS

| | | | | |
|---|---|---|---|---|
| 4,868,984 | A | 9/1989 | Elsherbini | |
| 5,213,116 | A | 5/1993 | Stein | |
| 5,237,750 | A * | 8/1993 | Nakano et al. | 30/131 |
| 5,367,772 | A * | 11/1994 | Ogawa | 30/201 |
| 5,519,939 | A | 5/1996 | Smith | |
| 5,724,736 | A | 3/1998 | Smith | |
| 5,884,402 | A | 3/1999 | Talavera | |
| 6,494,214 | B1 * | 12/2002 | Coldicott | 132/213.1 |
| 6,588,108 | B2 | 7/2003 | Talavera | |
| 6,751,870 | B2 | 6/2004 | Tapia | |
| 6,877,230 | B2 | 4/2005 | Tapia | |
| 7,040,021 | B2 * | 5/2006 | Talavera | 30/133 |
| 7,243,661 | B2 | 7/2007 | Lun et al. | |
| 2002/0157262 | A1 | 10/2002 | Talavera | |
| 2003/0159296 | A1 | 8/2003 | Tapia | |
| 2004/0045168 | A1 | 3/2004 | Talavera | |
| 2004/0139615 | A1 * | 7/2004 | Gianatasio | 30/233 |
| 2004/0237313 | A1 | 12/2004 | Tanaka | |
| 2005/0044723 | A1 | 3/2005 | Sato | |
| 2005/0108880 | A1 | 5/2005 | Wan | |
| 2008/0072921 | A1 * | 3/2008 | Habibi | 132/224 |
| 2008/0127989 | A1 | 6/2008 | Chapman et al. | |
| 2010/0275944 | A1 | 11/2010 | Bandonis | |
| 2010/0325903 | A1 * | 12/2010 | Patel | 30/377 |
| 2011/0094532 | A1 | 4/2011 | Klein et al. | |
| 2011/0167639 | A1 * | 7/2011 | Lau | 30/34.1 |
| 2011/0173816 | A1 * | 7/2011 | Ben-Ari | 30/43.6 |
| 2011/0302789 | A1 | 12/2011 | Chen et al. | |
| 2012/0047748 | A1 | 3/2012 | Buchan | |

FOREIGN PATENT DOCUMENTS

| | | | |
|---|---|---|---|
| FR | 2947158 | A1 | 12/2010 |
| JP | H02241479 | A | 9/1990 |
| TW | 200500183 | A | 1/2005 |
| TW | M349832 | U | 2/2009 |
| WO | 2004113032 | A3 | 12/2004 |
| WO | WO2012/041982 | A1 | 4/2012 |

OTHER PUBLICATIONS

International Preliminary Report on Patentability dated Oct. 1, 2014, in International Patent Appl. PCT/US2013/033891 filed Mar. 26, 2013.

Office Action dated Nov. 25, 2014, in European Patent Appl. 13718000.6 filed Mar. 26, 2013.

English Abstract of International Publication No. WO2012/041982 published on Apr. 5, 2012.

Amendment dated Jun. 4, 2015, in European Patent Appl. 13718000.6 filed Mar. 26, 2013.

Office Action dated Aug. 24, 2015, in Chinese Patent Appl. 201380018171.0 filed Mar. 26, 2013.

Office Action dated Nov. 25, 2015, in European Patent Appl. 13718000.6 filed Mar. 26, 2013.

Amendment dated Feb. 9, 2016, in European Patent Appl. 13718000.6 filed Mar. 26, 2013.

* cited by examiner

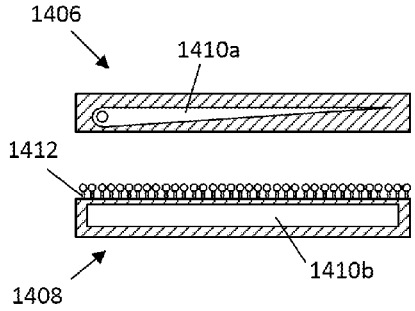
FIG. 14A
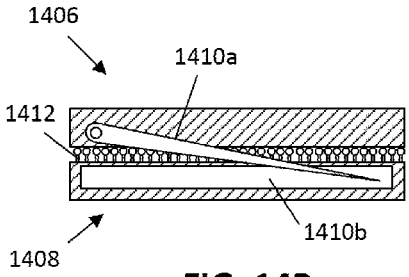
FIG. 14B
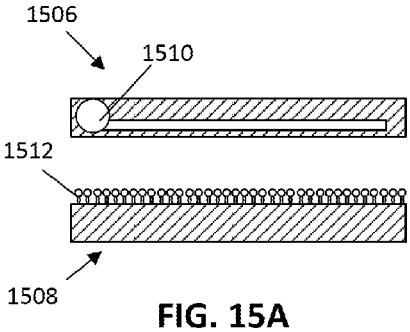
FIG. 15A
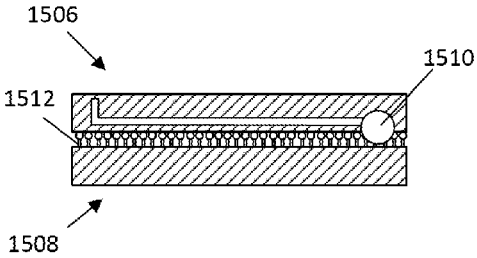
FIG. 15B
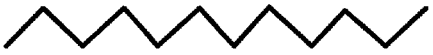
FIG. 16A
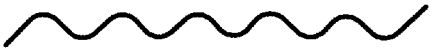
FIG. 16B
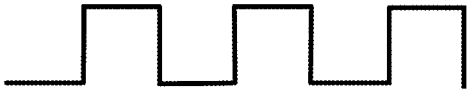
FIG. 16C
FIG. 16D
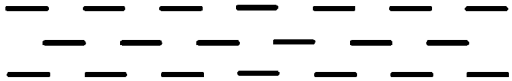
FIG. 16E

DEVICE FOR CUTTING HAIRS

PRIORITY CLAIM

The present application claims priority under 35 U.S.C. 119(e) to U.S. Provisional Patent Application No. 61/618,155, which was filed Mar. 30, 2012, and U.S. Provisional Patent Application No. 61/745,362, which was filed Dec. 21, 2012, each of which is incorporated herein by reference.

FIELD OF THE INVENTION

Embodiments of the present invention relate to handheld devices for cutting hairs.

BACKGROUND OF THE INVENTION

Scissors have been used for cutting hairs for centuries. However, significant skill is required to properly collect the hairs, secure them, and then apply the scissors to achieve a good cut. Additionally, hair clippers, which typically include a pair of blades, have been available for decades as a barber's tool. Manual hair clippers are operated by a pair of handles which are alternately squeezed together and released. Barbers used them to cut hairs close and fast. The hairs were picked up in locks and the head was rapidly depilated. Such haircuts became popular among boys, mostly in schools, and young men in the military. Electric hair clippers work in the same way as manual ones, but are driven by an electric motor which makes at least one the blades reciprocate relative to the other. Accessories such as clipper guides allow for adjustment in length of the cut, but generally the length is only extendable to a half-an-inch. The limitation in clipper guide length prevents their practical use for cutting long hairs. Pinching with one hand and cutting with the other using available clippers is difficult and does not assure the safety of the user or provide a consistency in the angle of cut.

SUMMARY OF THE INVENTION

Embodiments of the present invention are related to handheld devices for cutting hairs. In accordance with specific embodiments, a handheld device for cutting hairs includes a pair of opposing surfaces that are actuatable so that the hairs are capable of being held between the opposing surfaces with sufficient firmness to allow the hairs to be pulled taut without being cut. Actuation of the pair of opposing surfaces refers to movement of one or both of the opposing surfaces in a manner that enables hairs to be positioned and held between the opposing surfaces, preferably with sufficient firmness to allow the hairs to be pulled taut without being cut. Once the hairs are in position, they are held secured by the opposing surfaces whether or not the hair is being pulled taut. The device further includes a cutter actuatable independent of the opposing surfaces and configured to cut the hairs held between the opposing surfaces when the cutter is actuated. Actuation of the cutter minimally refers to movement of at least one blade of the cutter in a manner that causes hairs to be sheared or otherwise cut. In certain embodiments, actuation of the cutter also requires that at least one blade of the cutter extends outward from a recess or window to thereby bring the at least one blade in contact with hairs.

The pair of opposing surfaces can be connected with or integrally formed with respective arms of a pair of arms. In certain embodiments, the pair of arms are pivotably connected at a hinge and biased apart by a spring force so that the opposing surfaces are actuated by overcoming the spring force. Alternatively, the hinge may bias the arms together, such that the user must overcome a force to open the hinge, and when the user ceases to overcome the force the hinge closes to grasp the hairs. This embodiment may contain design features that enable the user to grasp each arm by placing one or more fingers and/or a thumb through one or more ring.

In certain embodiments, the pair of opposing surfaces are pivotable relative to a pivot point along the length of the arms, with opposing surfaces biased open, such that portions of the arms on one side of the pivot point must be squeezed together to bring the opposing surfaces on the other side of the pivot point together. Alternatively, the opposing surfaces can be biased closed, such that portions of the arms on one side of the pivot point must be squeezed together to separate the opposing surfaces on the other side of the pivot point.

The cutter can include a single blade. Alternatively, the cutter can include a pair of blades, at least one of which is moveable relative to the other. In certain embodiments, at least a portion of the cutter is recessed within one of the opposing surfaces prior to actuation, thereby preventing hairs from being cut until the cutter is actuated. For example, a blade of the cutter can be received within a recess or a window of one of the opposing surfaces so that when actuated the blade breaks a plane formed by the other one of the opposing surfaces which can include a complementary blade and across which hairs extend.

In certain embodiments, the cutter is manually actuated by pivoting the arms of the device in a manner that causes an edge of one blade of the cutter to move past an edge of a complementary blade of the cutter, thereby causing the cutter to shear hairs between the two blades.

In alternative embodiments, the cutter includes a pair of blades, at least one of which reciprocates from side-to-side relative to the other when an electric motor is turned on. Both of the blades can move (i.e., reciprocate). Alternatively, one blade moves and the other blade is held stable. Each of the blades can include shearing teeth. In such embodiments, the cutter is actuated when the electric motor is energized, thereby causing at least one of the blades to reciprocate relative to the other to cut hairs. The teeth of the blades can be arranged so that all of the hairs arranged along a length of the blades are cut upon actuation of the cutter by shearing the hairs between shearing edges of the teeth of blades. Alternatively, the plurality of teeth of at least one of the blades can be staggered so that only a portion of the hairs arranged along a length of the blades are cut upon actuation of the cutter, to achieve thinning of the hairs.

In alternative embodiments, the cutter includes a circular blade that rolls along at least a portion of a length of the opposing surfaces upon actuation. In such embodiments, the circular rolling blade compresses the hairs between itself and a complementary surface or complementary blade, shearing the hairs as the circular blade rolls over them.

In certain embodiments, the cutter is associated with one of the opposing surfaces and separately biased away from the other of the opposing surfaces. In some embodiments, the cutter is actuated by overcoming the separate bias so that the cutter is urged toward the other of the opposing surfaces.

In certain embodiments, the cutter has a cutting surface arranged at an angle relative to the hairs such that an angled cut is applied to the hairs when the cutter is actuated.

In certain embodiments, the opposing surfaces are substantially flat. In other embodiments, the opposing surfaces are curved. In certain embodiments where the opposing surfaces are curved the cutter is a curved blade and the cutter is actuated by rotating the curved blade into one of the opposing surfaces.

In some embodiments, at least one of the surfaces includes one or more sets of bristles and/or one or more sets of comb teeth extending toward the other of the surfaces when the opposing surfaces are actuated.

In certain embodiments, one or both of the opposing surfaces include a window to view the hairs held between the opposing surfaces.

In certain embodiments, one of the opposing surfaces is clear or semi-clear, or includes a clear or semi-clear portion, so that the hairs can be viewed through the surface.

In certain embodiments, the device includes a level to determine an orientation of the opposing surfaces relative to true horizontal.

In certain embodiments, the device includes a lock that prevents the cutter from actuating, wherein the lock must be unlocked prior to actuating the cutter and cutting the hairs.

In certain embodiment, the blades, combs, bristles and/or the paddles of the device may be removed and replaced for cleaning, maintenance, or for selection of various types of bristles, combs, or blades for different types of hairs or haircuts.

In certain embodiments the cutter is arranged in a pattern (e.g., a zigzag pattern) so that when the cutter is actuated hairs are cut in a corresponding pattern.

BRIEF DESCRIPTION OF THE DRAWINGS

FIGS. 14A and 14B are side views of a single edged blade for use with embodiments of devices in accordance with the present invention.

FIGS. 15A and 15B are side views of a rotating blade for use with embodiments of devices in accordance with the present invention.

FIGS. 16A-16E illustrate exemplary patterns that can be cut using devices of embodiments of the present invention.

DETAILED DESCRIPTION

Figure 1A:
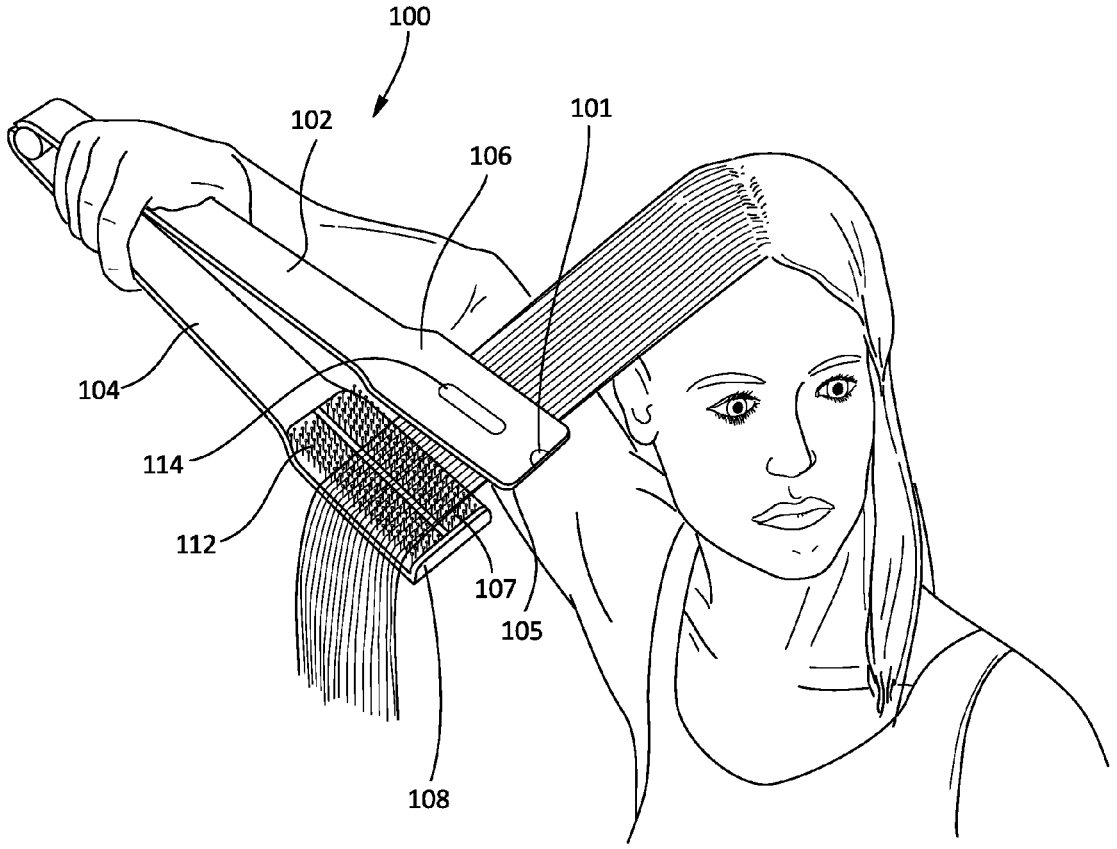
FIGS. 1A-1C are perspective views of an embodiment of a device for cutting hairs in accordance with an embodiment of the present invention in different stages of use.

The following description is of the best modes presently contemplated for practicing various embodiments of the present invention. The description is not to be taken in a limiting sense but is made merely for the purpose of describing the general principles of the invention. The scope of the invention should be ascertained with reference to the claims. In the description of the invention that follows, like numerals or reference designators will be used to refer to like parts or elements throughout. In addition, the first digit of a reference number identifies the drawing in which the reference number first appears.

In many of the embodiments described below, a handheld device includes a pair of opposing surfaces that are actuatable so that hairs are capable of being held between the opposing surfaces with sufficient firmness to allow the hairs to be pulled taut without being cut. Additionally, the device includes a cutter actuatable independent of the opposing surfaces and configured to cut the hairs held between the opposing surfaces when the cutter is actuated. This does not necessarily mean that the point at which the hairs are cut is a point between the opposing surfaces. Rather, depending on how and where the cutter is implemented, it is possible that the point at which the hairs are cut is right at a side, end or edge of one of the opposing surface. Either way, the hairs that are being cut are the hairs being held between the opposing surfaces.

Figure 1B:
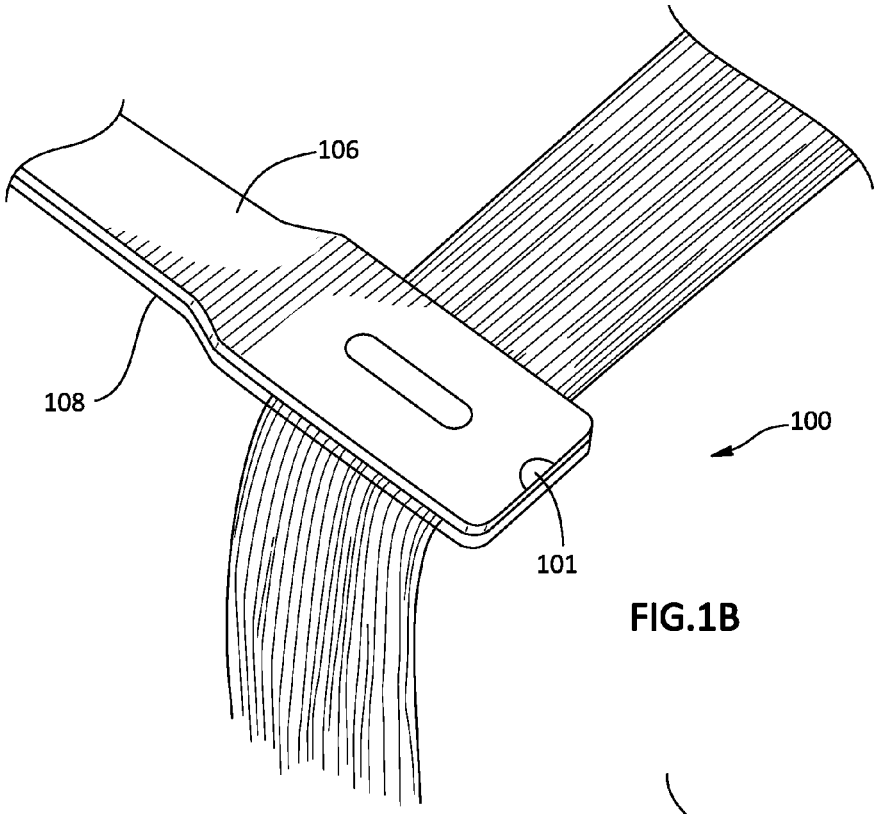
Figure 1C:
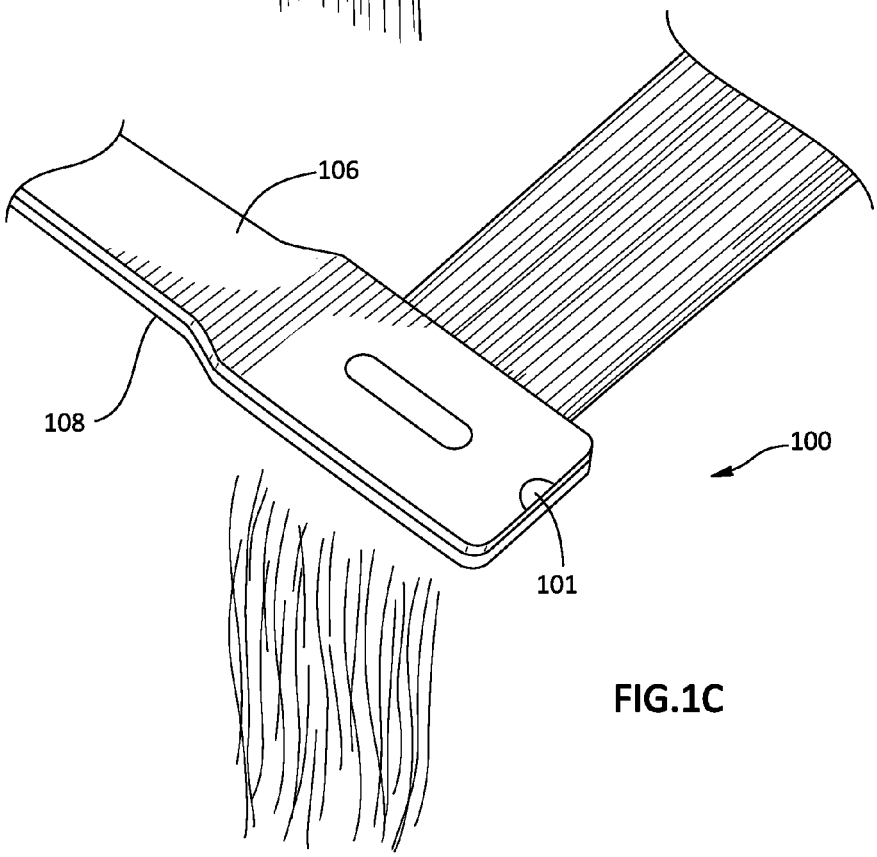

FIGS. 1A-1C are perspective views of an embodiment of a handheld device 100 for cutting hairs in accordance with an embodiment of the present invention. As shown, the device 100 resembles a pair of tongs having two arms 102, 104 hinged, pivoted, or otherwise fastened together and preferably biased open. As shown, the arms 102, 104 are spring biased open. Each of the arms 102, 104 has at an end a generally flat paddle 106, 108. The hairs are drawn over one or both of opposing surfaces 105, 107 of the paddles 106, 108. As shown, the device 100 includes a set of bristles 112 extending from one (or both) of the opposing surfaces 105, 107 and the hairs are generally straightened, aligned, and drawn taut from the head, as is generally achieved with a brush or comb when grooming. The arms 102, 104 of the device 100 can be urged together to fix the hairs in position between the opposing surface, as shown in FIG. 1B, after which the hairs may or may not remain drawn taut from the head.

As will be described in additional detail below, a cutter (not shown in FIGS. 1A-1C) can be actuated to cut hairs at a predefined location along the opposing surfaces, or at an edge of the opposing surfaces. The cutter can be electrically, mechanically, or otherwise actuated. If the cutter is electrically actuated, a power supply of the device 100 can be powered by a cord that can be plugged into an outlet, or alternatively the device 100 can be powered by battery. The device 100, or at least a portion of the device, can be fabricated from a clear or semi-clear material to allow the hairs to be seen through one or both of the paddles 106, 108 or the device 100 can include a window (e.g., an opening or gap) for viewing the hairs. For example, one or both of the paddles 106, 108 can be made of a clear or semi-clear plastic. It is also possible that one or both of the entire arms 102, 104 (including respective paddles 106, 108) can be made of a clear or semi-clear plastic. Alternatively or additionally, a representation can be painted or printed on the outside of the paddle(s) showing an approximate length at which cutting occurs. Further, while the paddles 106, 108 of the arms 102, 104 are illustrated as being wider than the other portions of the arms 102, 104, the arms 102, 104 can alternatively have a same width along their entire length, or the paddles 106, 108 can be narrower than other portions of the arms 102, 104.

The device 100 can further comprise a level indicator 114 on the outside of a paddle 106, 108 to allow a user to judge the angle of a cut relative to true horizontal. The level indicator 114 can be, for example, a digital reading of angle relative to true horizontal, a bubble level, a spirit level, or a visual signal, such as a light that changes color based on a distance from horizontal. Alternatively, the level indicator 114 can be actuated to give an audible reading of the paddle orientation to reduce a user's reliance on visual indicators which can be helpful when vision is partially obscured, for example when cutting bangs or hairs on the back of the user's head.

In specific embodiments, an outer surface of one of the paddles 106, 108 includes an actuation button 101, as shown in FIGS. 1A-1C. In certain embodiments, where the cutter is electrically actuated, the button 101 can provide two functions. For example, pressing the button 101 with a light force (e.g., insufficient to overcome a spring loaded bias) can turn on a motor (e.g., motor 1230 or 1330 in FIGS. 12A, 12B and 13) that reciprocates one (or two) blades without causing hairs to be cut; and pressing the button 101 with a greater force (e.g., sufficient to overcome the spring loaded bias) can cause a portion of the cutter to extend out from a recess or window within one of the paddles and begin cutting hairs. Alternatively, pressing the button 101 with a first force (e.g., sufficient to overcome the spring loaded bias) can cause a portion of the cutter to extend out from a recess or window within one of the paddles without turning on the motor; and pressing the button 101 with a second force that is greater than the first force can turn on the motor that reciprocates one (or two) blades to thereby cause hairs to be cut. In still other embodiments, pressing the button 101 will always both cause a portion of the cutter to extend out from a recess or window and turn on the motor. In further embodiments, each of the paddles 106, 108 can include their own respective button. In certain embodiments, only one of the two buttons needs to be pressed to actuate the cutter. In other embodiments, both of the two buttons need to be pressed to actuate the cutter. Where the cutter is not electrically actuated, but rather is mechanically actuated, pressing one (or two) button(s) can cause the cutter to be mechanically actuated.

In FIG. 1A, the button 101 is shown as being located at the opposite end of the arm 102 from which the arm 102 is hinged with the other arm 104, which requires that two hands be used to cut hairs. In operation, a user can hold the arms 102, 104 of the device 100 in one hand, and can press the one (or two) buttons using their other hand. A benefit of requiring that a user use two hands and press one (or two) button(s) to actuate the cutter is that it minimizes the possibility that the user will accidentally actuate the cutter and cause hairs to be cut to an unintended length. In alternative embodiments, the button(s) can be located on an outer surface(s) of one (or both) of the arms 102, 104, closer to where the arms are hinged, which would enable the user to press the button(s) with the same hand that holds the arms 102, 104 of the device 100. While a button is only shown in FIGS. 1A-1C, one or two similar button(s) can be included in each of the embodiments described below.

Figure 2A:
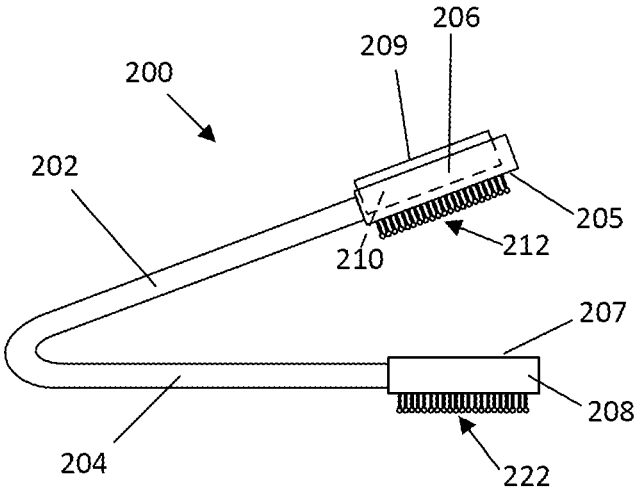
FIGS. 2A-2C are side views of an alternative embodiment of a device for cutting hairs in accordance with an embodiment of the present invention in different stages of use.
Figure 2B:
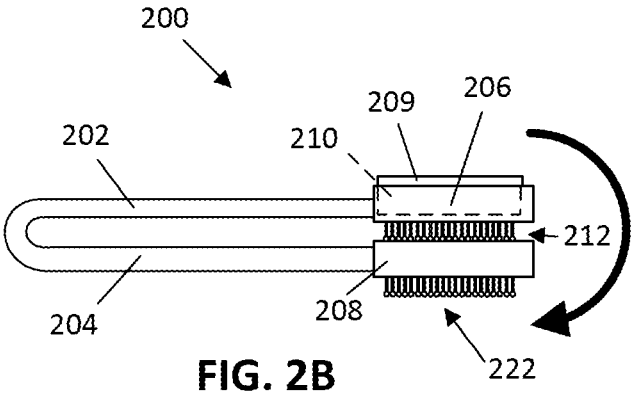
Figure 2C:
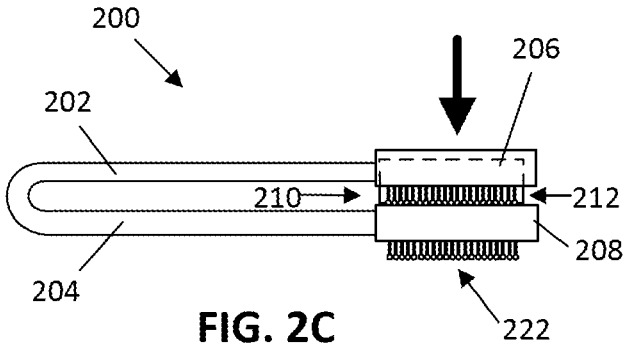

FIGS. 2A-2C are side views of an alternative embodiment of a device 200 for cutting hairs in accordance with the present invention. As with the previous embodiment, the device 200 resembles a pair of tongs having two arms 202, 204 integrally formed and spring biased open. The embodiment includes a cutter 210 that is connected with a separately movable portion 209 of a first paddle 206 which is biased away from the grasping opposing surfaces 205, 207 of the paddles 206, 208. As shown in FIG. 2B, the arms 202, 204 of the device can be urged together so that a surface 207 of the second paddle 208 contacts a surface 205 or bristles 212 of the first paddle 206 with the hairs held therebetween. The cutter 210 then can be separately actuated by overcoming a bias force of the movable portion 209 electrically or mechanically and urging the movable portion 209 toward the surface 207 of the second paddle 208. In a similar manner as was discussed above with respect to FIGS. 1A-1C, one or two buttons can be used to actuate the cutter 210 and/or overcome the bias force of the movable portion 209.

In another embodiment the device 200 is configured such that the arms 202, 204 are biased toward one another such that the opposing surfaces 205, 207 normally touch or nearly touch one another. In such an embodiment, a user would need to overcome a bias force to separate the arms 202, 204 from one another, which would separate the opposing surfaces 205, 207 from one another, at which time hairs can be positioned between the opposing surfaces 205, 207. When the user ceases to overcome the bias force, the opposing surfaces 205, 207 would move back toward one another to grasp the hairs therebetween. To implement this embodiment, design features (e.g., rings) can be added to the arms 202, 204 to enable the user to grasp each arm (e.g., by placing one or more fingers and a thumb through a respective ring) in a manner that allows the user to overcome the bias force that normally biases the arms 202, 204 toward one another.

In FIGS. 2A-2C, an outer peripheral surface of the paddle 208 is shown as including another set of bristles 222 (or comb teeth), which can be used to brush hairs straight prior to grasping the hairs between the opposing surfaces 205, 207. While only shown in FIGS. 2A-2C, similar bristles 222 (or comb teeth) can be added to the outer surface of one or both paddles in all of the other embodiments described herein.

Figure 2D:
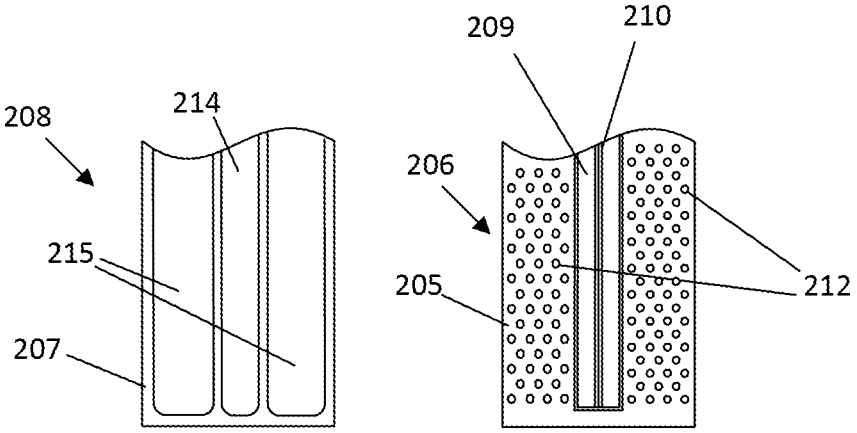
FIGS. 2D and 2E are partial plan and cross-sectional views of opposing surfaces of the device of FIGS. 2A-2C.
Figure 2E:
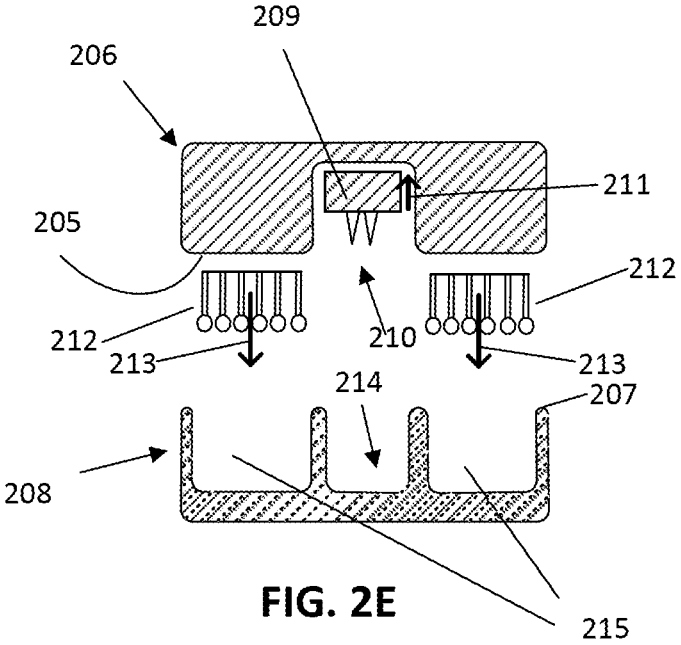

FIG. 2D is a partial plan view and FIG. 2E is a cross-sectional view of the opposing surfaces 205, 207 in accordance with an embodiment. Referring to FIGS. 2D and 2E, the first paddle 206 includes the moveable portion 209 on which is mounted the cutter 210. The moveable portion 209 is shown as being approximately centered along a length of the paddle 206, but need not be. For example, the movable portion 209 and the cutter 210 can be located at or close to one of the sides of the paddle 206. As shown, the cutter 210 includes a pair of blades (at least one of which reciprocates relative to the other) that extends along at least a portion of the first paddle 206. Additional details of such types of blades can be understood from FIGS. 12A, 12B and 13, and the description thereof. In other embodiments, the cutter 210 can comprise some other cutting instrument, such as a first blade that shears the hairs against a second blade held on or within a recess of the second surface 207. As can be seen in FIG. 2E, the cutter 210 is recessed relative to a plane defined by the first surface 205 so that when the first and second paddles 206, 208 are urged toward each other, the cutter 210 does not necessarily cut the hairs. The cutter 210 is recessed by biasing the moveable portion 209 away from the first surface 205. The moveable portion 209 can be biased, for example using spring force applied by a coil or leaf spring. Alternatively, the moveable portion 209 can be biased using some other technique, such as magnetic force. The cutter 210 can then be separately actuated by overcoming the bias force electrically and/or mechanically to urge the movable portion 209 toward the surface of the second paddle 208.

As can be seen in FIGS. 2D and 2E, the first surface 205 opposing the second surface 207 includes two sets of bristles 212 extending from the first paddle 206 toward the second surface 207 for grooming the hairs and/or straightening the hairs for cutting. The second surface 207 includes two grooves 215 for receiving the bristles 212 so that when the paddles 206 and 208 are urged toward each other with hairs passing through the bristles 212, portions of the opposing surfaces 205 and 207 can be pressed together such that they are touching or almost touching, compressing the hairs between them. The second surface 207 also includes a further groove 214 for receiving at least a portion of the cutter 210, so that when the cutter 210 is actuated at least a portion of the cutter 210 breaks a plane defined by a non-grooved portion of the second surface 207. In an embodiment, the second paddle 208 is made of a clear or semi-clear material so that hairs can be seen through the paddle, as can be seen in the cross-sectional view of FIG. 2E. In an embodiment, the entire second arm 204, including the second paddle 208, is made of a clear or semi-clear material, such as a clear or tinted plastic. In an embodiment, one or more of the grooves 215 and 214 can be replaced with window openings that extend completely through the paddle 208. In an embodiment, the two sets of bristles 212 are removable (as represented by arrows 213 in FIG. 2E) so that the user may use both sets, one set or none, as well as to allow for easy cleaning of the bristles. An arrow 211 in FIG. 2E is illustrative of a bias force that causes the cutter 210 to be normally recessed relative to the first surface 205.

In FIGS. 2A-2C, the arms 202, 204 are shown as being integrally formed. Alternatively, the arms 202, 204 can be separately formed and connected at adjacent ends by a hinge, similar to what is shown in FIG. 1A.

Figure 3A:
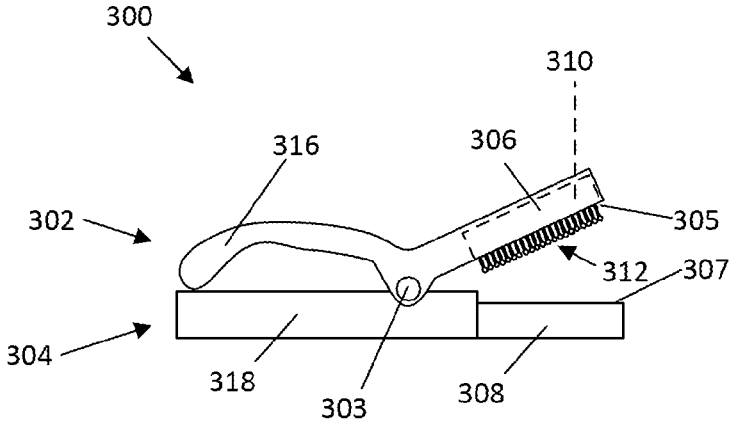
FIGS. 3A-3C are side views of a further embodiment of a device for cutting hairs in accordance with an embodiment of the present invention in different stages of use.
Figure 3B:
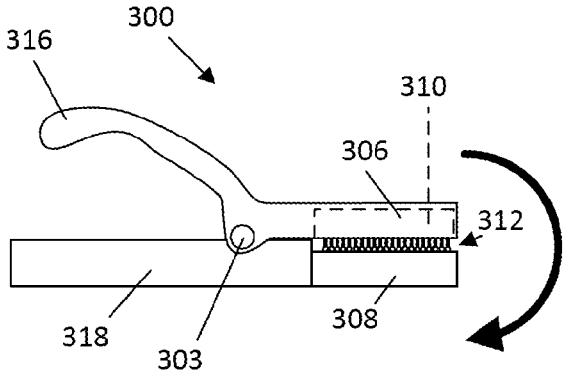
Figure 3C:
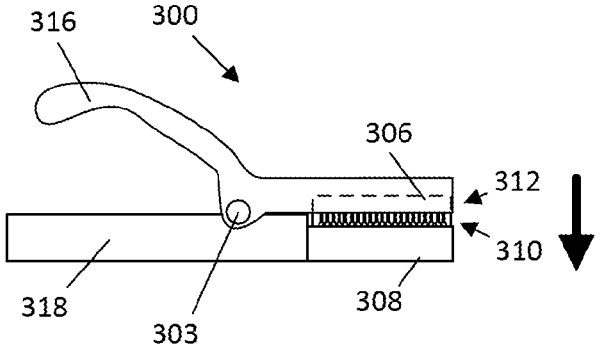

In still further embodiments, the device need not comprise a pair of arms biased away from each other relative to a hinge at adjacent ends of a pair of arms. In other embodiments, opposing surfaces can be biased toward each other (or away from each other) relative to a pivot point (also known as a fulcrum) that is between the ends of the arms. For example, the device could resemble a curling iron with a lever that can be squeezed to separate the opposing surfaces. Referring to FIGS. 3A-3C, an embodiment of a device 300 in accordance with the present invention is shown comprising a pair of paddles 306 and 308 having opposing surfaces 305, 307 biased toward each other. The device 300 has a grip 318 and a lever 316 that is squeezed toward the grip 318 or otherwise urged to separate the opposing surfaces 305, 307 so that hairs can be arranged for cutting. The lever 316 is then released to capture the hairs. The hairs can be loosely captured between bristles 312 of one or both of the opposing surfaces 305, 307, or more firmly captured, for example where the opposing surfaces lack bristles or comb teeth. A cutter 310 can then be actuated (e.g., using one or two buttons) to cut the hairs held therebetween. The lever 316 and the paddle 306 can be considered portions of one arm 302 of the device 300, and the grip 318 and the paddle 308 can be considered portions of another arm 304 of the device 300. In such embodiments, one or both of the opposing surfaces 305, 307 rotate relative to a pivot point 303 located between the ends of the arms 302, 304.

Referring to FIGS. 4A-11B, various further possible configurations of opposing surfaces for grasping hairs are shown. The configurations are not intended to be limiting, but rather are intended to illustrate the variability with which the opposing surfaces can be designed while achieving the results of grasping hairs with sufficient firmness to allow the hairs to be pulled taut to arrange them for cutting, continuing to hold the hairs secure for cutting, and of subsequently cutting the hairs. Each of these embodiments can be modified such that bristles extend from both of the opposing surfaces, from only one of the two opposing surfaces, or from neither of the opposing surfaces. Additionally, each of these embodiments can be modified such that at least a portion of the device is fabricated from a clear or semi-clear material (e.g., a transparent or translucent plastic) to allow the hairs to be seen through one or both of the paddles, or a window (e.g., an opening or gap) can be included one or both of the paddles for viewing the hairs.

Figure 4A:
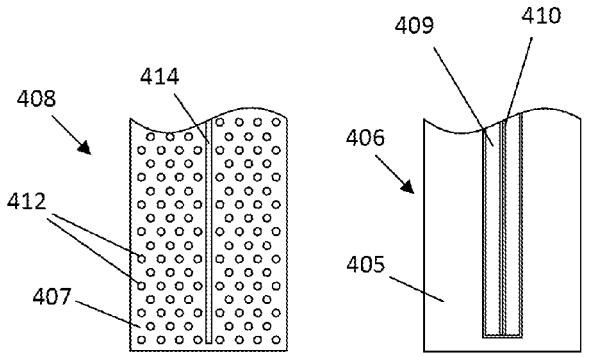
FIGS. 4A and 4B are partial plan and cross-sectional views of opposing surfaces of another embodiment of a device for cutting hairs in accordance with the present invention.
Figure 4B:
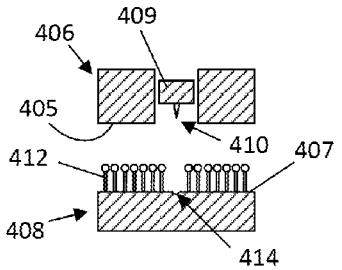

FIG. 4A is a partial plan view and FIG. 4B is a cross-sectional view of alternative opposing surfaces for use with embodiments of devices in accordance with the present invention. A first paddle 406 includes a moveable portion 409 on which is mounted a cutter 410. The moveable portion 409 is approximately centered along a length of the paddle 406. As shown, the cutter 410 is a single blade that extends along at least a portion of the first paddle 406. In other embodiments, the cutter can comprise some other instrument, such as a pair of single or double acting blades (also referred to herein as reciprocating blades, examples of which are described with reference to FIGS. 12A, 12B and 13). As can be seen in FIG. 4B, the cutter 410 is recessed relative to a plane defined by the first surface 405 so that when the first and second paddles 406, 408 are urged toward each other, the cutter 410 does not necessarily cut the hairs. The cutter 410 is recessed by biasing the moveable portion 409 away from the first surface 405. The moveable portion 409 can be biased, for example using spring force applied by a coil or leaf spring. Alternatively, the moveable portion 409 can be biased using some other technique, such as magnetic force. The cutter 410 can then be separately actuated by overcoming the bias force electrically and/or mechanically to urge the movable portion 409 toward the surface of the second paddle 408. A second surface 407 opposing the first surface 405 includes bristles 412 extending from the second paddle 408 toward the first surface 405 for grooming the hairs and/or straightening the hairs for cutting. The second surface 407 includes a shallow groove 414 for receiving the cutter 410 so that when actuated the cutter 410 breaks a plane defined by the second surface 407.

Figure 5A:
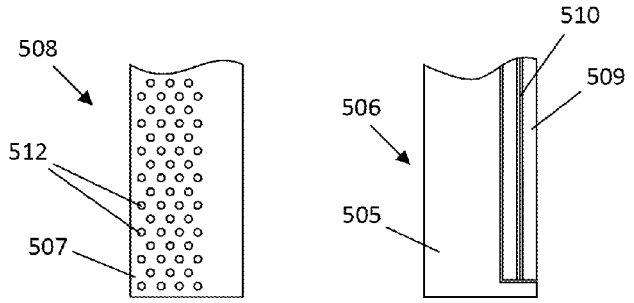
FIGS. 5A and 5B are partial plan and cross-sectional views of opposing surfaces of an alternative embodiment of a device for cutting hairs in accordance with the present invention.
Figure 5B:
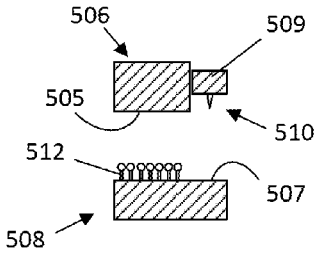

FIG. 5A is a partial plan view and FIG. 5B is a cross-sectional view of alternative opposing surfaces 505, 507 for use with embodiments of devices in accordance with the present invention. A first paddle 506 includes a moveable portion 509 on which is mounted a cutter 510, but the moveable portion 509 is arranged at one end of the paddle 506 rather than centered. As above, the cutter 510 is a single blade that extends along at least a portion of the first paddle. In other embodiments, the cutter can comprise some other instrument. As can be seen in FIG. 5B, the cutter 510 is recessed relative to a plane defined by the first surface 505 and can be separately actuated by overcoming the bias force electrically and/or mechanically to urge the movable portion toward the surface of the second paddle 508. A second surface 507 opposing the first surface 505 includes bristles 512 extending from the second paddle 508 toward the first surface 505 for grooming the hairs and/or straightening the hairs for cutting. While not shown in FIG. 5B, the second surface 507 can include a shallow groove similar to the groove 414 (in FIG. 4B) for receiving the cutter 510, and the first surface 505 can include a groove similar to the grooves 215 (in FIG. 2E for receiving the bristles 512. The second surface 507 can additionally include a complementary blade against which a blade associated with the first surface 505 may shear hairs. In FIG. 5B the cutting blade is shown as being inset a little from one side of the paddle 506, but can alternatively be located right at one side of the paddle 506. Similarly, a complementary blade can be located right at one side of the paddle 508.

Figure 6A:
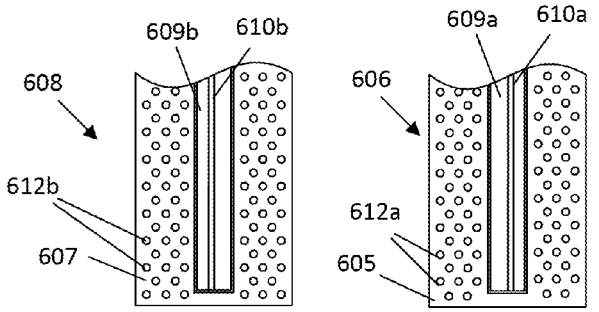
FIGS. 6A and 6B are partial plan and cross-sectional views of opposing surfaces of a further embodiment of a device for cutting hairs in accordance with the present invention.
Figure 6B:
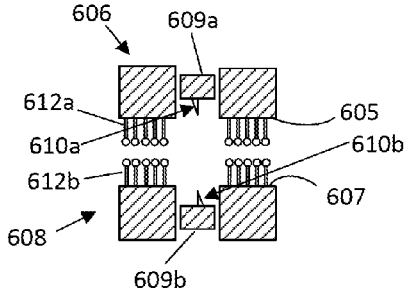

FIG. 6A is a partial plan view and FIG. 6B is a cross-sectional view of further opposing surfaces 605, 607 for use with embodiments of devices in accordance with the present invention. A first paddle 606 and a second paddle 608 each include moveable portions 609*a*, 609*b* on which are mounted cutter blades 610*a*, 610*b*. The moveable portions 609*a*, 609*b* are approximately centered and aligned along the respective paddles 606, 608. As shown, the cutter blades 610*a*, 610*b* are blades that extend along at least a portion of the respective paddle 606, 608. As shown in FIG. 6B, the cutter blades 610*a*, 610*b* are recessed relative to a plane defined by each surface 605, 607 so that when the first and second paddles 606, 608 are urged toward each other, the cutter blades 610*a*, 610*b* do not cut the hairs. The cutter blades 610*a*, 610*b* are separately actuated by overcoming the bias force electrically and/or mechanically and urging the movable portions 609*a*, 609*b* toward each other until the cutter blades 610*a*, 610*b* cut the hairs. The cutter blades 610*a*, 610*b* can be arranged to move past or otherwise shear against each other when actuated, as scissor blades do, or they can abut at their edges, although alignment may be less reliable. The surfaces of the first and second paddles 606, 608 include bristles 612*a*, 612*b* for grooming the hairs and/or straightening the hairs for cutting. Rather than being centered, the movable portions 609*a*, 609*b* and cutter blades 610*a*, 610*b* can be at sides, end or edges of the paddles 606, 608, similar to the blade 510 shown in FIGS. 5A and 5B.

Figure 7A:
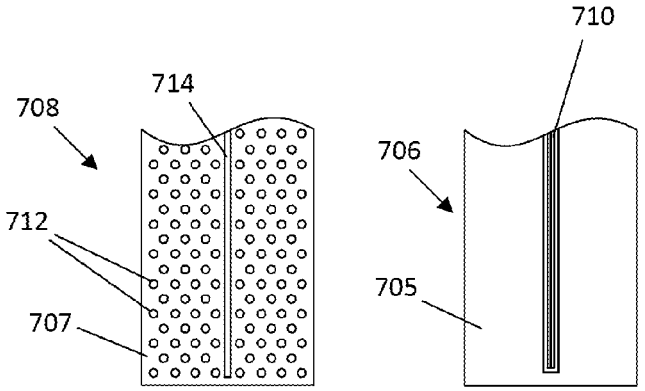
FIGS. 7A and 7B are partial plan and cross-sectional views of opposing surfaces of a further embodiment of a device for cutting hairs in accordance with the present invention.
Figure 7B:
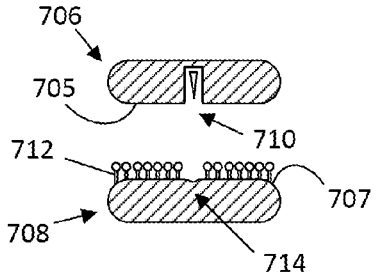

FIG. 7A is a partial plan view and FIG. 7B is a cross-sectional view of further opposing surfaces 705, 707 for use with embodiments of devices in accordance with the present invention. A first paddle 706 includes a cutter 710 approximately centered along a length of the paddle 706 and fully recessed within a pocket of the paddle 706 so that when the first and second paddles 706, 708 are urged toward each other, the cutter 710 does not cut the hairs. As above, the cutter 710 is a single blade that extends along at least a portion of the first paddle 706. In other embodiments, the cutter 710 can comprise some other instrument, such as a pair of double acting blades (also referred to herein as reciprocating blades). The cutter 710 can be separately actuated to urge the cutter 710 out of the pocket and toward an opposing second surface 707. The second surface 707 includes bristles 712 extending from the second paddle 708 toward the first surface 705 for grooming the hairs and/or straightening the hairs for cutting. The second surface 707 includes a shallow groove 714 for receiving the cutter 710 so that when actuated the cutter 710 breaks a plane defined by the second surface 707. Note also that the paddles 706, 708 can have other shapes than those previously shown, and that the first and second paddles 706, 708 of FIGS. 7A and 7B are further rounded along the edges. Paddle shapes can be designed for aesthetic as well as functional reasons.

Figure 8A:
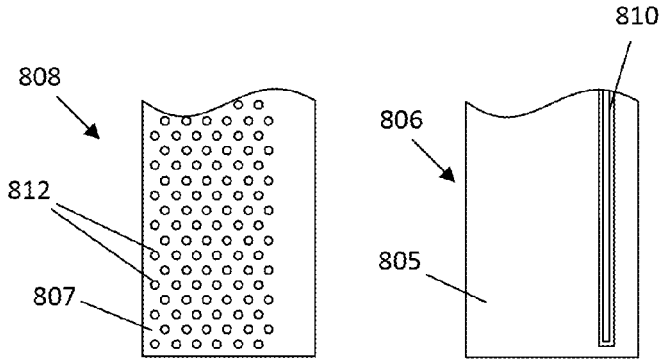
FIGS. 8A and 8B are partial plan and cross-sectional views of opposing surfaces of a further embodiment of a device for cutting hairs in accordance with the present invention.
Figure 8B:
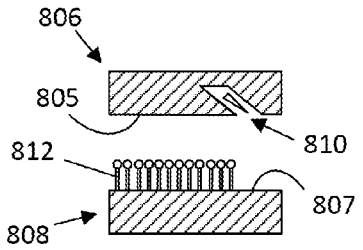

FIG. 8A is a partial plan view and FIG. 8B is a cross-sectional view of further opposing surfaces 805, 807 for use with embodiments of devices in accordance with the present invention. As above, a first paddle 806 includes a cutter 810 fully recessed within a pocket of the paddle 806 so that when the first and second paddles 806, 808 are urged toward each other, the cutter 810 does not cut the hairs. The cutter 810 is a single blade that extends along at least a portion of the first paddle 806. However, unlike the previous embodiment, the single blade type cutter is arranged and extended out at an angle to a plane formed by a surface of the paddle 806 so that the hairs are cut at an angle. In other embodiments, the cutter 810 can comprise some other instrument. The cutter can be separately actuated to urge the cutter 810 out of the pocket and toward an opposing second surface 807. The second surface 807 includes bristles 812 extending from the second paddle 808 toward the first surface 805 for grooming the hairs and/or straightening the hairs for cutting.

Figure 9A:
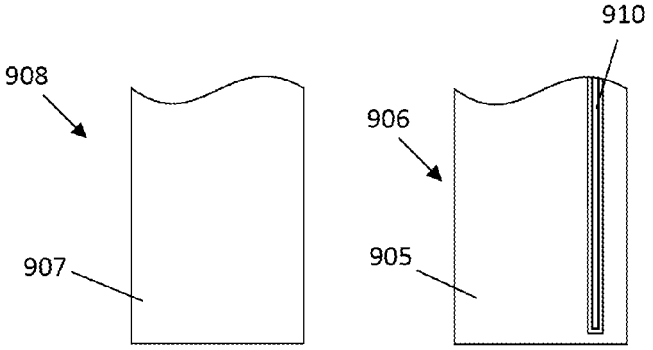
FIGS. 9A and 9B are partial plan and cross-sectional views of opposing surfaces of a further embodiment of a device for cutting hairs in accordance with the present invention.
Figure 9B:
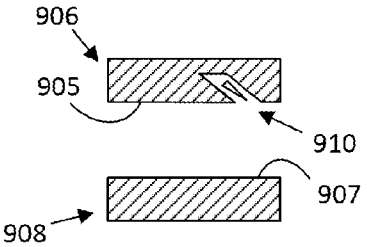

Although the previous embodiments include bristles extending from one or both surfaces, in other embodiments, the device need not include bristles. For example, an embodiment similar to that shown in FIGS. 8A and 8B is shown in FIGS. 9A and 9B having paddles 906, 908 without bristles extending from opposing surfaces 905, 907. Also shown in FIGS. 9A and 9B is a cutter 910, similar to the cutter 810 discussed above with reference to FIGS. 8A and 8B.

Figure 10A:
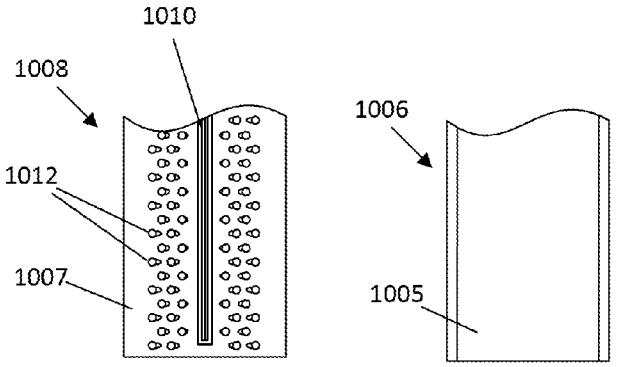
FIGS. 10A and 10B are partial plan and cross-sectional views of opposing surfaces of a further embodiment of a device for cutting hairs in accordance with the present invention.
Figure 10B:
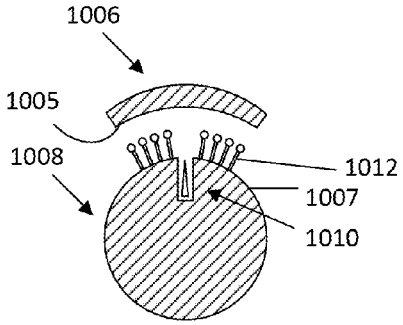

FIG. 10A is a partial plan view and FIG. 10B is a cross-sectional view of further opposing surfaces 1005, 1007 for use with embodiments of devices in accordance with the present invention. Unlike previous embodiments, the opposing surfaces are curved. A barrel 1008 includes a first surface 1007 having bristles 1012 extending away from the surface and a cutter 1010 fully recessed within a pocket of the barrel 1008. As above, the cutter 1010 is a single blade that extends along at least a portion of the barrel 1008. In other embodiments, the cutter 1010 can comprise some other instrument, such as a pair of double acting blades. The first surface 1007 includes bristles 1012 extending from the barrel 1008 toward a paddle 1006 for grooming the hairs and/or straightening the hairs for cutting. The cutter 1010 can be separately actuated to urge the cutter 1010 out of the pocket and toward an opposing second surface 1005. The second surface 1005 of the paddle 1006 is substantially smooth and curved to complement the rounded shape of the barrel 1008. While not shown, the second surface 1005 can include grooves to receive the blade and/or the bristles 1012, similar to as shown in FIG. 2E.

Figure 11A:
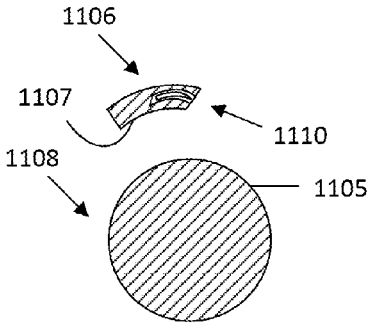
FIGS. 11A and 11B are cross-sectional views of opposing surfaces of a further embodiment of a device for cutting hairs in accordance with the present invention.
Figure 11B:
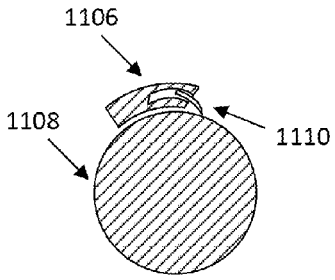

FIGS. 11A and 11B are cross-sectional views of further opposing surfaces 1105, 1107 for use with embodiments of devices in accordance with the present invention in a first, released configuration and a second configuration whereby the opposing surfaces 1105, 1107 are urged together and a cutter 1110 is actuated to cut hairs arranged therebetween. A barrel 1108 includes a first surface 1105 that is substantially smooth with no features. A paddle 1106 includes second surface 1007 that is likewise smooth and includes a cutter 1110 fully recessed within a pocket. The cutter 1110 is a single blade that extends along at least a portion of the second surface 1007. In other embodiments, the cutter 1110 can comprise some other instrument, such as a pair of double acting blades. The cutter 1110 is pivoted out of the curved pocket to contact the barrel 1108 and cut the hairs extending outward of the mated surfaces. In certain embodiments, the first surface 1005 may have a groove to receive the cutter 1110 so that the hairs are cut as the cutter 1110 passes the surface 1005 into the groove. A complementary blade can optionally be located within such a groove.

Referring to FIGS. 12-15, various possible cutters for use with embodiments of the present invention are shown. The configurations are not intended to be limiting, but rather are intended to illustrate the variability in form factor of a cutter. Blades used as cutters are can be made, for example, of stainless steel, which is much less prone to rusting than normal steel, or ceramic. Ceramic cutters are corrosion-free and stay sharper longer because of a higher resistance to wear than metal blades. Alternatively, blades can be made of some other material known in the art.

Figure 12A:
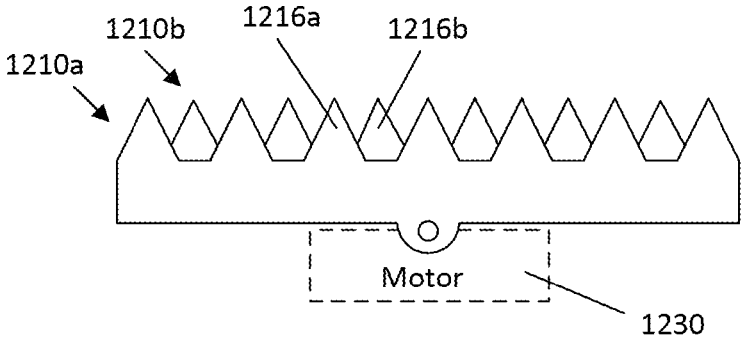
FIGS. 12A and 12B are side views of a motorized reciprocating blade assembly for use with embodiments of devices in accordance with the present invention.
Figure 12B:
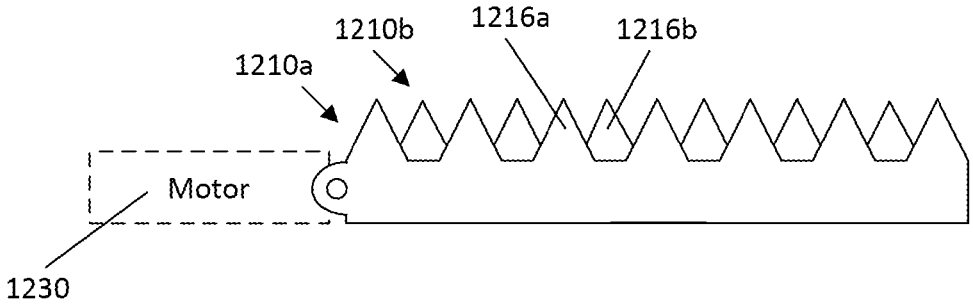

FIG. 12A is a side view of an alternative cutter for use in embodiments of the present invention comprising a pair of blades 1210*a*, 1210*b*, where at least one of the blades reciprocates relative to the other. The blades 1210*a*, 1210*b* comprise teeth 1216*a*, 1216*b* that are offset between the blades 1210*a*, 1210*b* so that gaps between the teeth 1216*a*, 1216*b* receive the hairs. At least one of the blades 1210*a*, 1210*b* is moved from side to side relative to the other using a motor 1230, closing off the gaps and severing (also referred to as shearing) the hairs arranged between. In certain embodiments, only one of the blades 1210*a*, 1210*b* moves, while the other is secured in place. Each of the teeth of 1216*a* of the blade 1210*a*, and/or each of the teeth 1216*b* of the blade 1210*b*, includes one or two sharp edges, which can also be referred to as shearing edges. As the teeth of one of the blades reciprocate relative to the teeth of the other one of the blades, hairs between the teeth are sheared by the shearing edges of the teeth. In FIG. 12A, one or both of the blades 1210*a*, 1210*b* is/are connected with the motor 1230 at the heel of the blade(s). In other embodiments the blades 1210*a*, 1210*b* can have some other shape with some other point of reciprocation. For example, as shown in FIG. 12B, one or both of the blades 1210*a*, 1210*b* is/are connected with the motor 1230 at the side of the blade(s). For another example, the blades can include tangs that extend from the blades and are connected with a motor. One of ordinary skill in the art will appreciate the different form factors and shapes of reciprocating blades which can be applied to embodiments of the present invention. The motor 1230 can produce rotational motion that is converted into reciprocating motion using, e.g., gears, cams, and/or the like. However, the use of other types of motors capable of reciprocating one or two blades are also within the scope of an embodiment.

Figure 13:
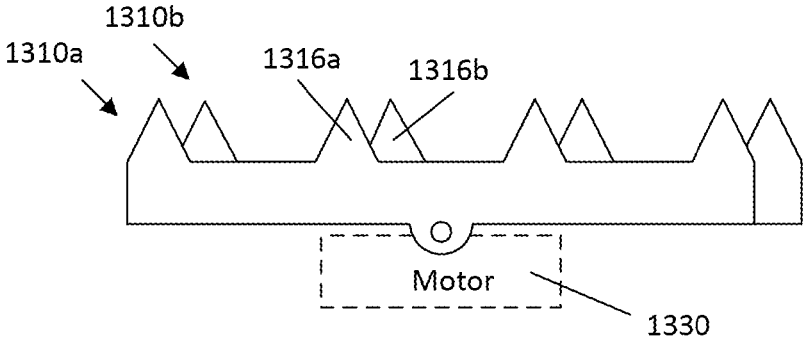
FIG. 13 is a side view of an alternative motorized reciprocating blade assembly for use with embodiments of devices in accordance with the present invention.

FIG. 13 is a side view of a further cutter for use in embodiments of the present invention to thin out hairs. The cutter includes a pair of blades 1310*a*, 1310*b* that comprise teeth 1316*a*, 1316*b* that are offset between the blades 1310*a*, 1310*b* so that gaps between the teeth 1316*a*, 1316*b* receive the hairs. In comparison to the embodiment of FIG. 12A, larger gaps exist between pairs of teeth 1316*a*, 1316*b* so that when one or both of the blades 1310*a*, 1310*b* are reciprocated; only some of the hairs are cut, so that some remain uncut. The hairs are thus thinned out rather than completely severed. As above, one or both of the blades 1310*a*, 1310*b* are connected with a reciprocating motor 1330 at the heel of the blades 1310*a*, 1310*b*, but in other embodiments the blades can have some other shape with some other point of reciprocation, e.g., as shown in FIG. 12B, but not limited thereto.

FIGS. 14A and 14B are side views of a further cutter for use in embodiments of the present invention to cut hairs. The cutter includes a blade 1410*a* connected with a first paddle 1406 that is actuated by pivoting the blade down toward a second paddle 1408 in a scissoring fashion, rather than a blade that is wholly urged toward the second paddle 1408. The second paddle 1408 contains a complementary surface, or a complementary blade 1410*b* against which the blade 1410*a* passes to shear the hairs. Where there is a complementary blade 1410*b* it can be secured in place as shown, or can also pivot. Also shown in FIGS. 14A and 14B are bristles 1412.

FIGS. 15A and 15B are side views of a further cutter for use in embodiments of the present invention to cut hairs. The cutter 1510 includes a circular blade connected with a first paddle 1506 that is actuated by urging the circular blade across the first paddle 1506, rolling over a complementary surface of a second paddle 1508 and cutting hairs as the circular blade 1510 passes over them. Alternatively, the second paddle 1508 can include a further rolling circular blade, or a further blade that is secured in place. Also shown in FIGS. 15A and 15B are bristles 1512.

In many of the above described embodiments, the cutters were generally shown as including one or two blades that were straight. However, the blades can alternatively be zigzagged, be staggered for one or more rows of thinning, or have some other pattern, so that the hairs being cut by the blades are cut in the pattern. Examples of such patterns are shown in FIGS. 16A, 16B, 16C, 16D and 16E. For example, FIG. 16D shows a thinning pattern that can be achieved, e.g., using a single pair of blades. FIG. 16E shows a thinning pattern that can be achieved, e.g., using three pairs of blades that are parallel to one another and spaced apart from one another. A myriad of other patterns are also possible, and are within the scope of embodiments of the present invention.

While FIGS. 1A-1C and the detailed description suggest that embodiments of devices in accordance with the present invention be used by a person to cut their own hairs, the devices need not be limited to such use. Embodiments of devices in accordance with the present invention can instead be used by a person to cut another person's hairs.

The previous description of the preferred embodiments is provided to enable any person skilled in the art to make or use the embodiments of the present invention. While the invention has been particularly shown and described with reference to preferred embodiments thereof, it will be understood by those skilled in the art that various changes in form and details may be made therein without departing from the spirit and scope of the invention. For example, combinations of the various embodiments described above are also within the scope of the present invention.

The invention claimed is:

1. A handheld device for cutting hairs comprising:

a pair of opposing surfaces actuatable so that hairs are capable of being held firmly against and between the opposing surfaces, orthogonal to a longitudinal axis of the handheld device, with sufficient firmness to allow the hairs to be pulled taut without being cut, such that proximal portions of the hairs that are closer to a head extend tautly from a first side of the opposing surfaces and distal portions of the hairs that are further from the head extend freely and visibly from a second side of the opposing surfaces opposite the first side;

a cutter actuatable independent of the opposing surfaces and configured to cut hairs held firmly against and between the opposing surfaces when the cutter is actuated, such that some or all of the distal portions of the hairs that are further from the head and extend freely and visibly from the second side of the opposing surfaces are severed from the proximal portions of the hairs when the cutter is actuated, thereby enabling cutting hairs to any one of various different lengths as determined on-the-fly by a user of the device; and an electric motor;

wherein the cutter includes a pair of blades that each include a plurality of cutting teeth arranged along at least a portion of a width of one of the opposing surfaces;

wherein the electric motor causes at least one of the blades to reciprocate relative to the other when the cutter is actuated;

wherein the blades of the cutter are normally recessed relative to one of the opposing surfaces by a first bias force;

wherein the blades of the cutter are parallel to the longitudinal axis of the handheld device; and wherein at least a portion of the blades of the cutter extend beyond the one of the opposing surfaces when the first bias force is overcome, to thereby bring the blades in contact with hairs held firmly against and between the opposing surfaces.

2. The device of claim 1 further comprising at least one of a set of bristles or a set of comb teeth extending from one of the opposing surfaces, wherein the at least one of the set of bristles or the set of comb teeth extends toward the other one of the opposing surfaces when the opposing surfaces are actuated.

3. The device of claim 2 wherein the at least one of the set of bristles or the set of comb teeth is removable and/or repositionable.

4. The device of claim 1 wherein:

each of opposing surfaces includes a respective planar surface;

at least one of a set of bristles or a set of comb teeth extends from a first one of the planar opposing surfaces;

the second one of the planar opposing surfaces includes at least one groove or window that accepts the at least one of the set of bristles or the set of comb teeth extending from the first one of the opposing surfaces when the opposing surfaces are actuated;

the at least one groove or window is parallel to the longitudinal axis of the handheld device; and actuation of the planar pair of opposing surfaces presses the planar pair of opposing surfaces together such that they are touching or almost touching so that hairs are compressed between them.

5. The device of claim 1 wherein:

the first bias force causes the pair of blades to be normally recessed relative to one of the opposing surfaces; and the cutter is actuated by both overcoming the first bias force and turning on the motor.

6. The device of claim 1 wherein the plurality of teeth are arranged so that substantially all of the hairs arranged along a length of the blades are cut upon actuation of the cutter.

7. The device of claim 1 wherein the plurality of teeth are staggered so that only a portion of the hairs arranged along a length of the blades are cut upon actuation of the cutter.

8. The device of claim 1 wherein each of the opposing surfaces is associated with an inner periphery of a respective paddle of a pair of paddles of the device, and further comprising a set of bristles or a set of comb teeth extending from an outer periphery of one of the paddles.

9. The device of claim 1 wherein:

the pair of opposing surfaces are connected with respective arms of a pair of arms;

the pair of arms are pivotably connected at a hinge;

the pair of arms are biased apart by a second bias force; and the opposing surfaces are actuated by overcoming the second bias force.

10. The device of claim 1 wherein the opposing surfaces are curved along their length.

11. The device of claim 1 wherein at least one of the opposing surfaces include a window and/or is made of a clear or semi-clear material so portions of hairs held between the opposing surfaces are viewable.

12. The device of claim 1 further comprising a level to determine an orientation of the opposing surfaces relative to true horizontal.

13. A handheld device for cutting hairs comprising:

first and second arms pivotally connected to one another at a hinge and having respective ends that are normally biased apart from one another by a first bias force;

a recess or window associated with the first arm;

a pair of blades having teeth, wherein the blades are parallel to a longitudinal axis of the handheld device, and wherein the teeth of the blades are normally recessed within the recess or window associated with the first arm by a second bias force; and an electric motor to reciprocate at least one of the blades relative to the other one of the blades when the motor is turned on;

wherein a first surface of the first arm and a second surface of the second arm are configured to hold hairs taut therebetween, the hairs orthogonal to the longitudinal axis of the handheld device, without cutting the hairs when the first bias force is overcome, such that proximal portions of the hairs that are closer to a head extend from a first side of the device and distal portions of the hairs that are further from the head extend freely and visibly from a second side of the device opposite the first side;

wherein at least a portion of the teeth of the blades extend out from the recess or window associated with the first arm when the second bias force is overcome; and wherein the device is configured to cut hairs held between the first and second surfaces when the first and second bias forces are both overcome and the motor is turned on, such that the distal portions of the hairs that are further from the head and extend freely and visibly from the second side of the device are severed from the proximal portions of the hairs when the motor is turned on, thereby enabling cutting hairs to any one of various different lengths as determined on-the-fly by a user of the device.

14. The device of claim 13 further comprising a button that is used to turn the motor on.

15. The device of claim 13 further comprising a button that is used to both overcome the second bias force and turn the motor on.

16. The device of claim 15 wherein the button is configured to:

turn the motor on in response to pressing of the button with a first amount of force; and overcome the second bias force in response to pressing of the button with a second amount of force that is greater than the first amount of force, which causes the at least a portion of the teeth of the blades to extend out from the recess or window associated with the first arm.

17. The device of claim 15 wherein the button is configured to:

overcome the second bias force in response to pressing of the button with a first amount of force, which causes the at least a portion of the teeth of the blades to extend out from the recess or window associated with the first arm; and turn the motor on in response to pressing of the button with a second amount of force that is greater than the first amount of force.

18. A handheld device for cutting hairs comprising:

first and second arms movable relative to one another;

a pair of blades associated with one of the first or second arms, wherein the blades are parallel to a longitudinal axis of the handheld device, and wherein each of the blades have teeth; and an electric motor to reciprocate at least one of the blades relative to the other one of the blades when the motor is turned on;

wherein a portion of the first arm and a portion of the second arm are configured to hold hairs taut therebetween, the hairs orthogonal to the longitudinal axis of the handheld device, without cutting the hairs, such that first portions of the hairs that are closer to a head extend from a first side of the arms and second portions of the hairs that are further from the head extend freely and visibly from a second side of the arms; and wherein turning on the motor and bringing the blades in contact with hairs held between the portions of the first and second arms causes the second portions of the hairs that are further from the head and extend freely and visibly from the second side of the arms to be severed from the first portions of the hairs, thereby enabling cutting hairs to any one of various different lengths as determined on-the-fly by a user of the device.

19. The device of claim 1 wherein:

one of the opposing surfaces is made of a clear or semi-clear material so portions of hairs held between the opposing surfaces are viewable through the one of the opposing surfaces that is made of the clear or semi-clear material; and the one of the opposing surfaces that is made of the clear or semi-clear material includes a representation showing an approximate length at which hairs will be cut in response to the cutter being actuated.

20. The device of claim 1, wherein:

the opposing surfaces, which are actuatable so that hairs are capable of being held firmly against and between the opposing surfaces, include planar opposing surfaces;

one of the planar opposing surfaces includes a recess in which the at least one blade of the cutter is normally recessed by the first bias force; and at least a portion of the at least one blade extends out of the recess and beyond the one of the planar opposing surfaces when the first bias force is overcome.

21. The device of claim 20, wherein:

the planar opposing surfaces, when actuated, hold hairs firmly against and between the planar opposing surfaces on both sides of the recess in which the at least one blade of the cutter is normally recessed by the first bias force.

22. The device of claim 1, wherein:

the opposing surfaces, which are actuatable so that hairs are capable of being held firmly against and between the opposing surfaces, include planar opposing surfaces;

the at least one blade of the cutter is normally recessed relative to one of the opposing planar surfaces by the first bias force; and the at least a portion of the at least one blade extends beyond the one of the opposing planar surfaces when the first bias force is overcome, to thereby bring the at least one blade in contact with hairs held firmly against and between the planar opposing surfaces.

* * * * *